US007562784B2

(12) United States Patent
Stevenson

(10) Patent No.: US 7,562,784 B2
(45) Date of Patent: Jul. 21, 2009

(54) ENCLOSURE ASSEMBLY

(75) Inventor: David Stevenson, Nr. Winchester (GB)

(73) Assignee: Le Carton Limited, Guernsey (GB)

( * ) Notice: Subject to any disclaimer, the term of this patent is extended or adjusted under 35 U.S.C. 154(b) by 411 days.

(21) Appl. No.: 10/479,766

(22) PCT Filed: May 31, 2002

(86) PCT No.: PCT/GB02/02569

§ 371 (c)(1),
(2), (4) Date: May 25, 2004

(87) PCT Pub. No.: WO02/098751

PCT Pub. Date: Dec. 12, 2002

(65) Prior Publication Data

US 2004/0211776 A1 Oct. 28, 2004

(30) Foreign Application Priority Data

Jun. 5, 2001 (GB) ..... 0113532.6

(51) Int. Cl.
*B65D 6/28* (2006.01)

(52) U.S. Cl. ..... 220/4.26

(58) Field of Classification Search ..... None
See application file for complete search history.

(56) References Cited

U.S. PATENT DOCUMENTS 3,581,932 A * 6/1971 Kreeger et al. ..... 206/506
4,079,836 A * 3/1978 Von Stein et al. ..... 206/513
4,212,415 A * 7/1980 Neely ..... 222/231
5,123,537 A * 6/1992 Gresens ..... 206/511
5,544,751 A * 8/1996 Klodt et al. ..... 206/509
2006/0096883 A1 * 5/2006 Raghunathan et al. ..... 206/506

FOREIGN PATENT DOCUMENTS

| | | |
|---|---|---|
| DE | 40 37 696 A | 4/1992 |
| FR | 2 805 528 A | 8/2001 |
| GB | 1 117 448 A | 6/1968 |
| NL | 9 300 986 A | 1/1995 |

* cited by examiner

*Primary Examiner*—Stephen Castellano
(74) *Attorney, Agent, or Firm*—Christensen O'Connor Johnson Kindness PLLC

(57) ABSTRACT

An enclosure assembly (1), and method of assembling transportation packaging therefrom, which is adapted to be supported on a container (2) and in situ the enclosure assembly encloses a region above the container, said enclosure assembly comprising co-operable attachment means (3, 7), the arrangement of the enclosure assembly being such that in use the attachment means of a first enclosure assembly which is supported on a container is engaged with the attachment means of a second enclosure assembly, said enclosure assemblies forming a stack in which the second enclosure assembly encloses a region above the first enclosure assembly. Advantageously, the enclosure assemblies can be stacked together to form a substantially rigid structure above the container according to the height of the goods in the container.

14 Claims, 8 Drawing Sheets

ENCLOSURE ASSEMBLY

CROSS-REFERENCE TO RELATED APPLICATIONS

The application is a national stage application of prior International Application No. PCT/GB02/02569, filed May 31, 2002, which claims the benefit of United Kingdom application No. 0013532, filed Jun. 5, 2001, which are incorporated herein by reference.

The present invention relates to enclosure assemblies and in particular to enclosure assemblies which are adapted to be supported on a container and in situ the enclosure assembly encloses a region above the container.

A known transport packaging arrangement is disclosed in CH 239659 which comprises three stackable elements. The elements comprise external fold-down buckle locks provided on side walls which serve to attach the elements together and the elements further comprising handle apertures which are provided on the end walls of the elements.

According to a first aspect of the invention there is provided an enclosure assembly which is adapted to be supported on a container and in situ the enclosure assembly encloses a region above the container, said enclosure assembly comprising co-operable attachment means and handle means, the arrangement of the enclosure assembly being such that in use the attachment means of a first enclosure assembly which is supported on a container is engaged with the attachment means of a second enclosure assembly, said enclosure assemblies forming a stack in which the second enclosure assembly encloses a region above the first enclosure assembly, the enclosure assembly being characterised in that first attachment means comprises protrusion means and second attachment means comprises protrusion receiving means, the protrusion receiving means being provided by a space which is sized to allow the fingers of a person to pass therethrough, and the space being provided below the handle means.

Preferably the enclosure assembly is of substantially tubular form and the distal ends of which are open.

Preferably the first attachment means is spaced from the second attachment means in the direction of the height of the enclosure assembly.

The first attachment means and the second attachment means are desirably located towards respective distal ends of the enclosure assembly.

In one preferred embodiment the first attachment means is located towards a lowermost margin of the enclosure assembly and the second attachment means is located towards an uppermost margin of the enclosure assembly.

The uppermost margin of the enclosure assembly may be adapted to provide mounting for lid means.

Preferably the first attachment means of one enclosure assembly is adapted to be engaged with the second attachment means of another enclosure assembly.

Preferably engagement between the first attachment means of one enclosure assembly and second attachment means of another enclosure is by way of a male-to-female arrangement.

Preferably the first attachment means is adapted to engage with a container so that the enclosure assembly is secured to the container to enclose a region above said container.

The protrusion means desirably comprises a portion which extends generally laterally of the enclosure assembly and which portion is adapted to be received by complementary protrusion receiving means.

Although in one preferred embodiment the first attachment means comprises a feature which is adapted to engage with either of a container or the second attachment means of another enclosure assembly, the first attachment means may comprise the (physically distinct features of) container attachment means and enclosure assembly attachment means. So, for example, a lowermost margin of an enclosure assembly may be provided at least one protrusion which is adapted to engage with a recess in a side wall of a container and at least one other protrusion which is adapted for engagement with a recess on a side wall of another enclosure assembly.

In a preferred embodiment of the invention there is provided an enclosure assembly which is adapted to be supported on a container and in situ the enclosure assembly encloses a region above the container, the enclosure assembly comprising protrusion means which is co-operable with a receiving means provided in a side wall of the container and the arrangement being such that in use the protrusion means is adapted to extend generally outwardly of the container and into the receiving means so as to secure the enclosure assembly to the container.

The first attachment means preferably comprises protrusion means which is provided secured to a resilient portion. The resilient portion desirably extends generally downwards of the enclosure assembly. The resilient portion is adapted to be deflectable in a direction which is generally lateral of the enclosure assembly.

Preferably where the enclosure is of oblong-rectangular shape, protrusion means are provided on opposite sides of the enclosure assembly.

The protrusion means is preferably of a tapered profile. The tapered profile most preferably widens laterally of the enclosure assembly with increasing height.

Preferred embodiments of the invention will now be described, by way of example only, with reference to the accompanying drawings in which.

Figure 1:
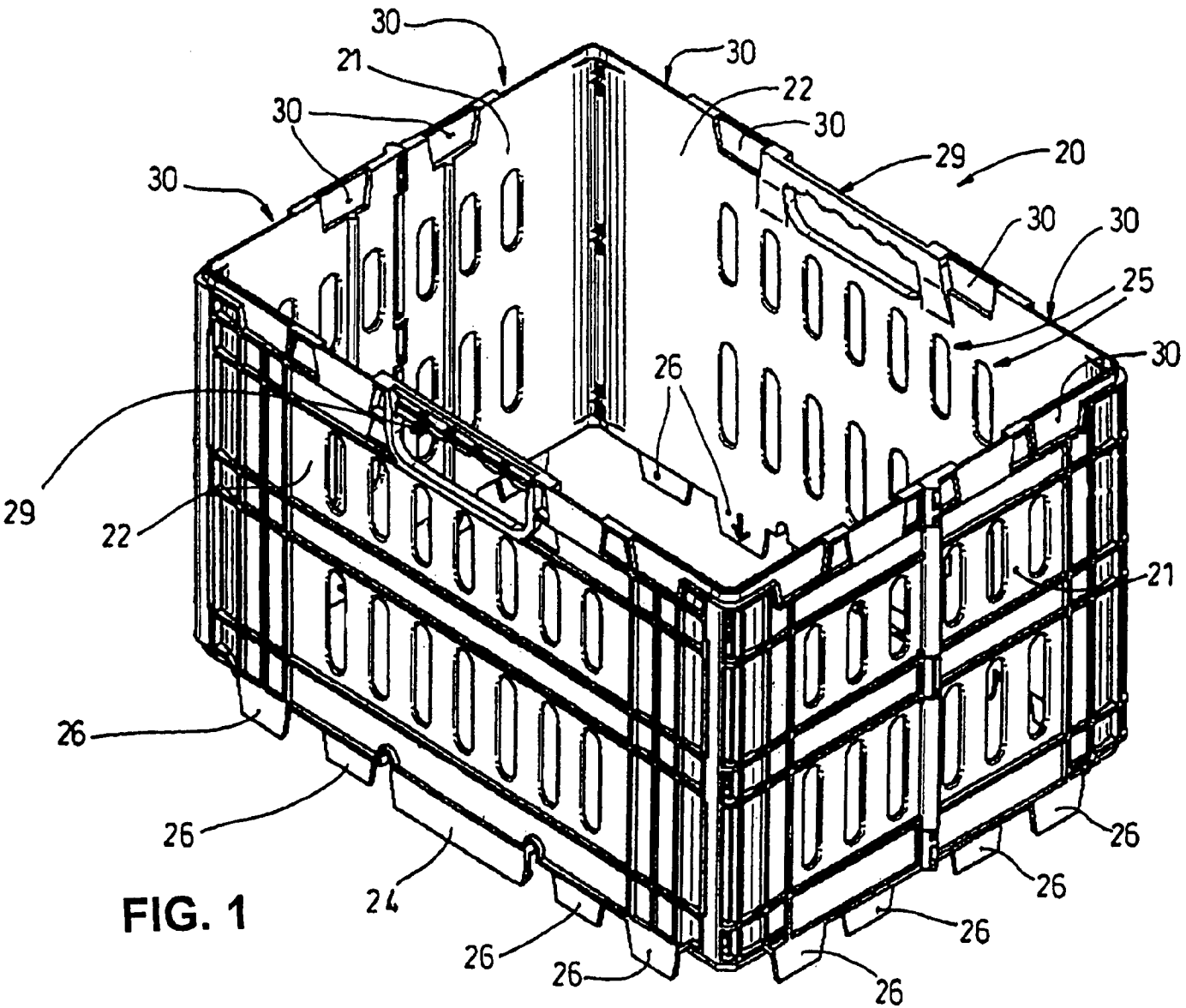
FIG. 1 shows a perspective view of a first embodiment of the invention.
Figure 2:
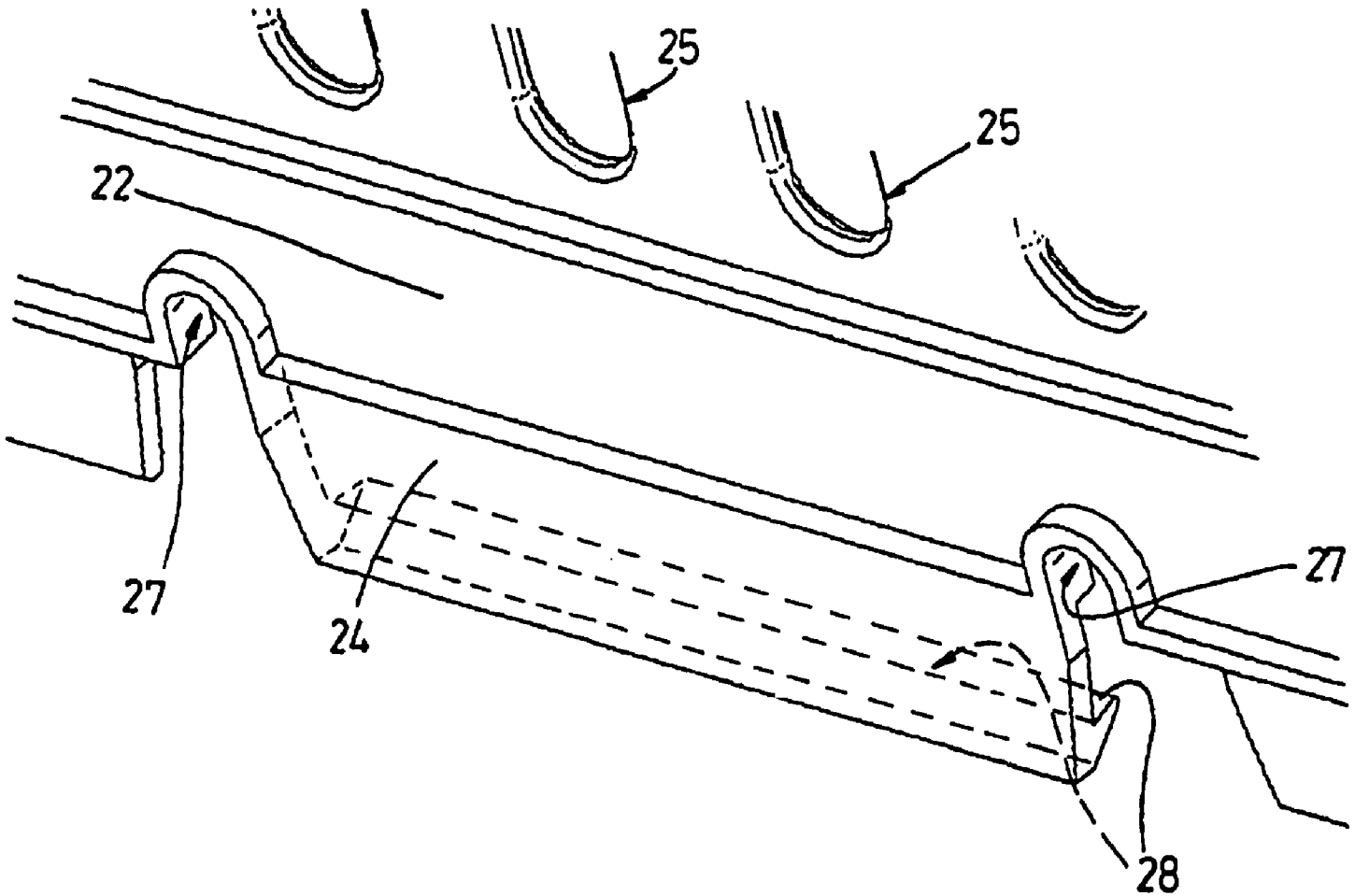
FIG. 2 shows a more detailed view of a resilient tongue of in the assembly shown in FIG. 1.

With reference to FIG. 1 there is shown an embodiment 20 of an enclosure assembly in accordance with the invention. The enclosure assembly 20 is of oblong-rectangular shape and comprises two end walls 21 and two side walls 22. Each of the walls 21 and 22 is provided with elongate apertures 25 for venting.

The lower margin of the assembly 20 comprises two resilient tongues 24, one on each side wall 22, and sixteen locating tabs 26.

Each side wall 22 is provided with a pair of tabs 26 on each side of the tongue 24, each pair of tabs 26 of each side wall 22 being spaced in the direction of the thickness of the side wall. Similarly, each end wall 21 comprises four locating tabs 26. The two innermost tabs on each end wall being spaced from the two outermost tabs in the direction of the thickness of the wall.

Each tongue 24 comprises an inwardly extending protrusion 28. A notch feature 27 is provided in the wall 22 on each side of the tongue 24 to enhance the resilience of the tongue laterally of the enclosure assembly 20.

The uppermost margin of the assembly 20 comprises two handles 29 and sixteen tab receiving recesses 30. The recesses 30 are sized and arranged to receive the tabs 26 of a second enclosure assembly 20.

Figure 3:
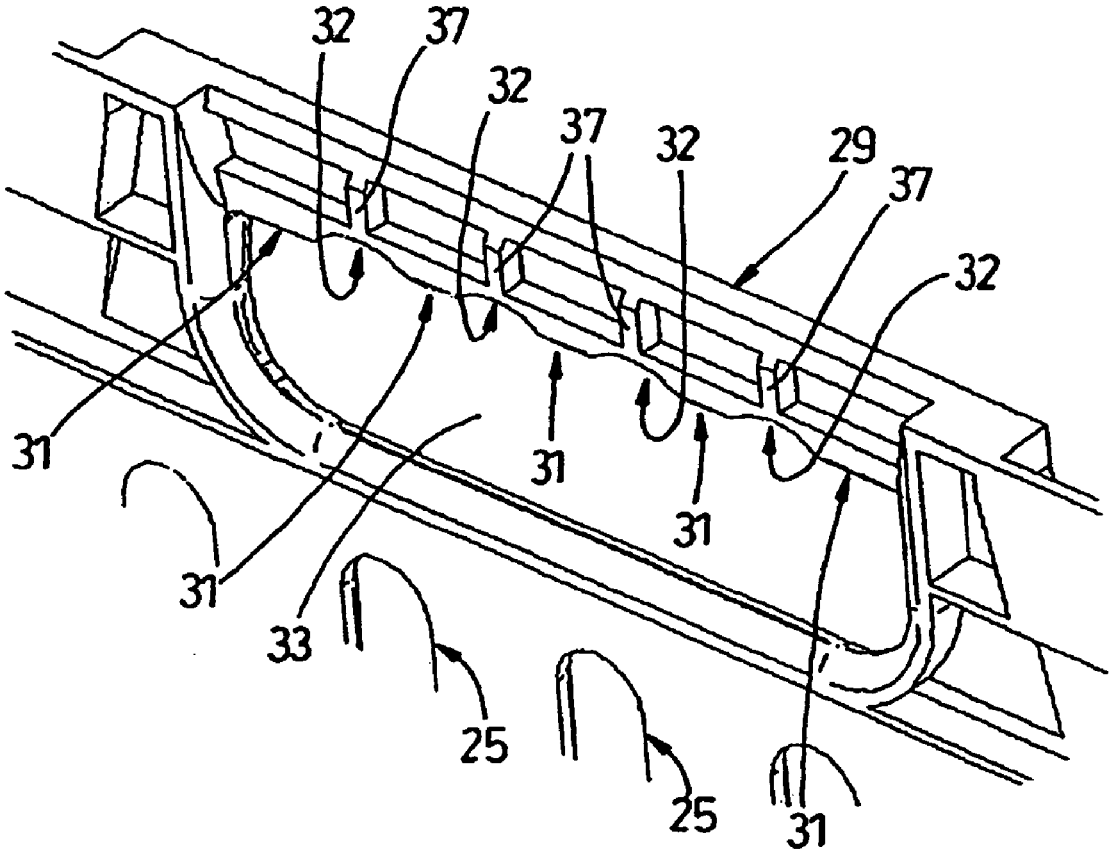
FIG. 3 shows a more detailed view of the outside of a handle of the assembly shown in FIG. 1.
Figure 4:
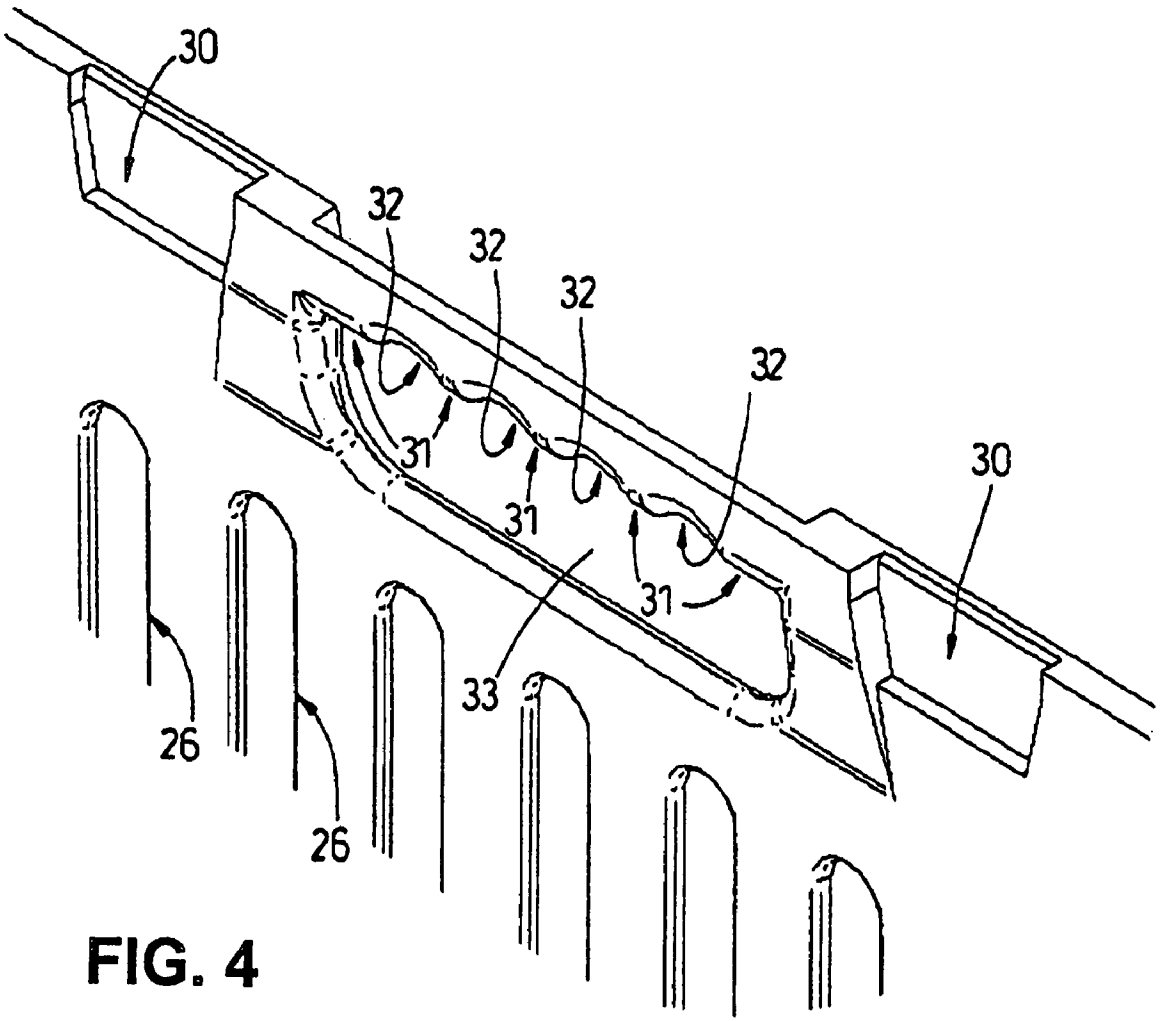
FIG. 4 shows a more detailed view of the inside of a handle of the assembly as shown in FIG. 3.

FIGS. 3 and 4 show a handle 29 in more detail. Each handle 29 comprises four recessed portions 32 of substantially circulate outline and five substantially flat surface portions 31, three of which are interposed between the recessed portions 32. Below each handle 29 a recess 33 is provided which is sufficiently large to allow the fingers of a person to pass there through. Each handle further comprises five outer ribs 37.

Figure 5:
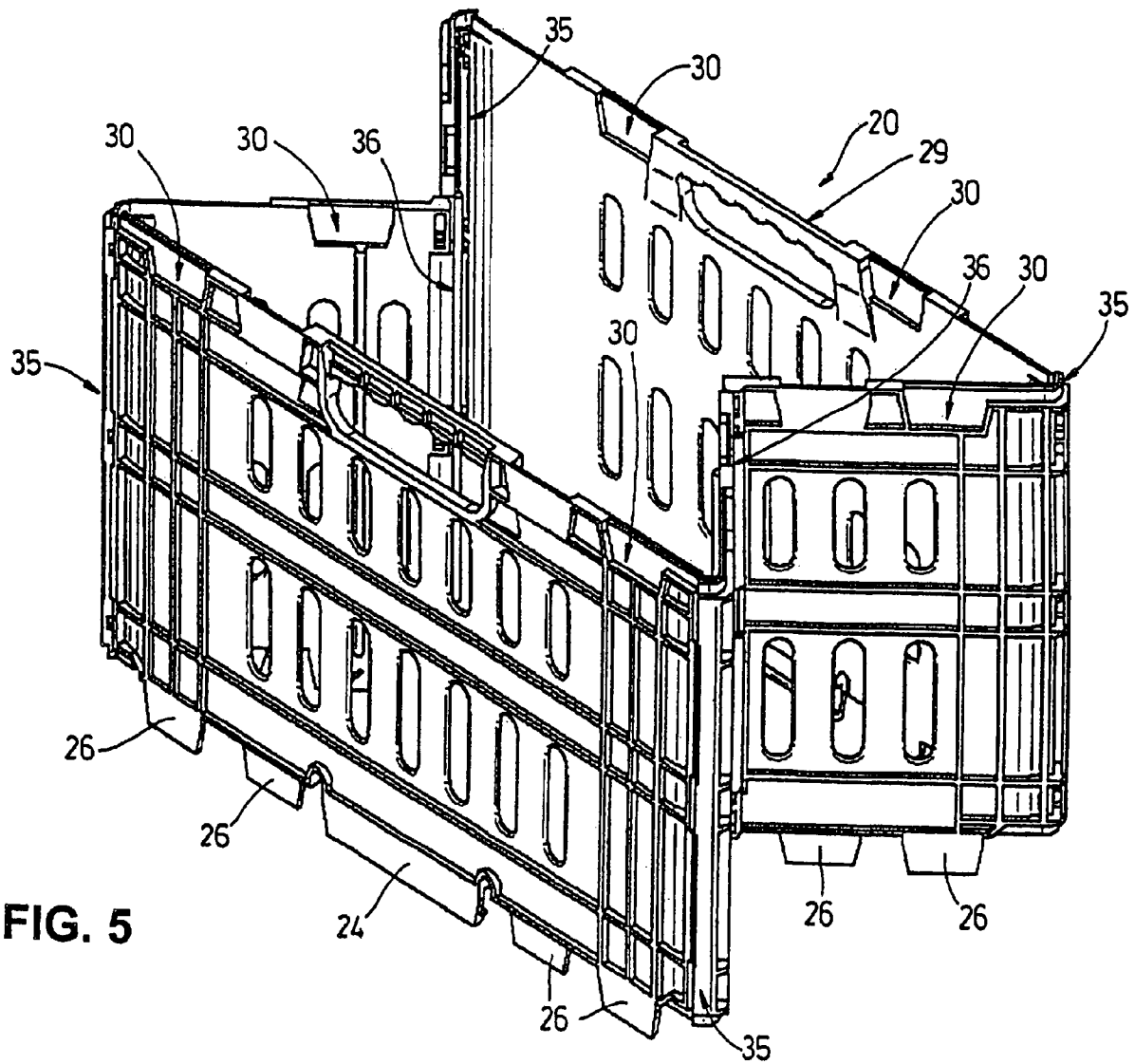
FIG. 5 shows a perspective view of the assembly shown in FIG. 1 in a semi-collapsed condition.

With reference to FIG. 5, the assembly 20 comprises four corner hinges 35 which are located at the interface between a side wall 22 and an end wall 21, and two hinges 36 which are located centrally of each end wall 21. As seen in FIG. 5, the hinges 35 and 36 conveniently allow the assembly to be arranged in a collapsed condition.

Figure 6:
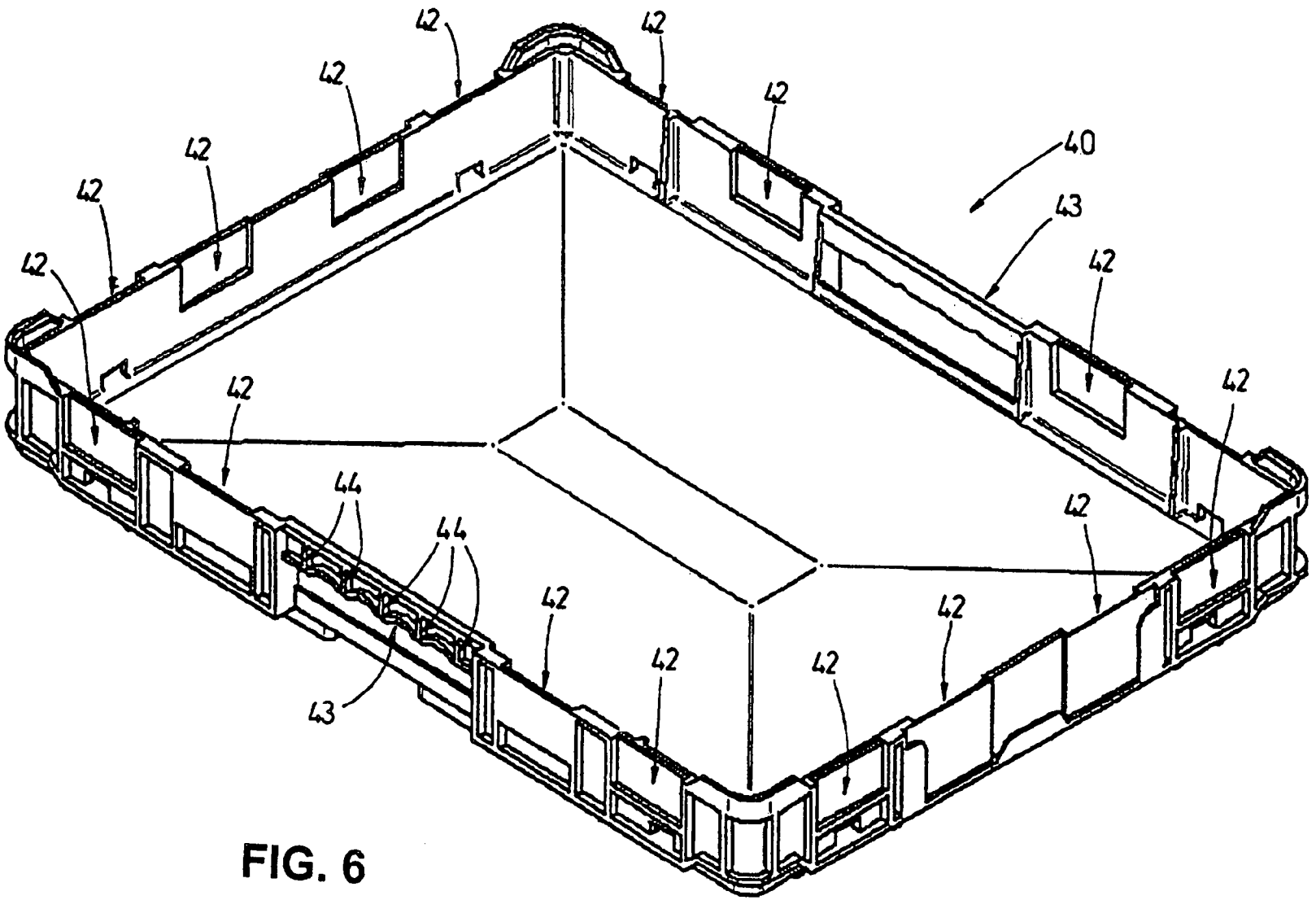
FIG. 6 shows a perspective view of a tray for use with the assembly shown in FIG. 1.

Turning to FIG. 6 there is shown a tray 40 for use with the enclosure assembly 20. The tray 40 comprises four walls, which walls are provided with two handles 43. The handles 43 are substantially identical to the handles 29 of the enclosure assembly 20. The recesses 42 are sized and arranged to locate the tabs 26 of the enclosure assembly 20.

Figure 7:
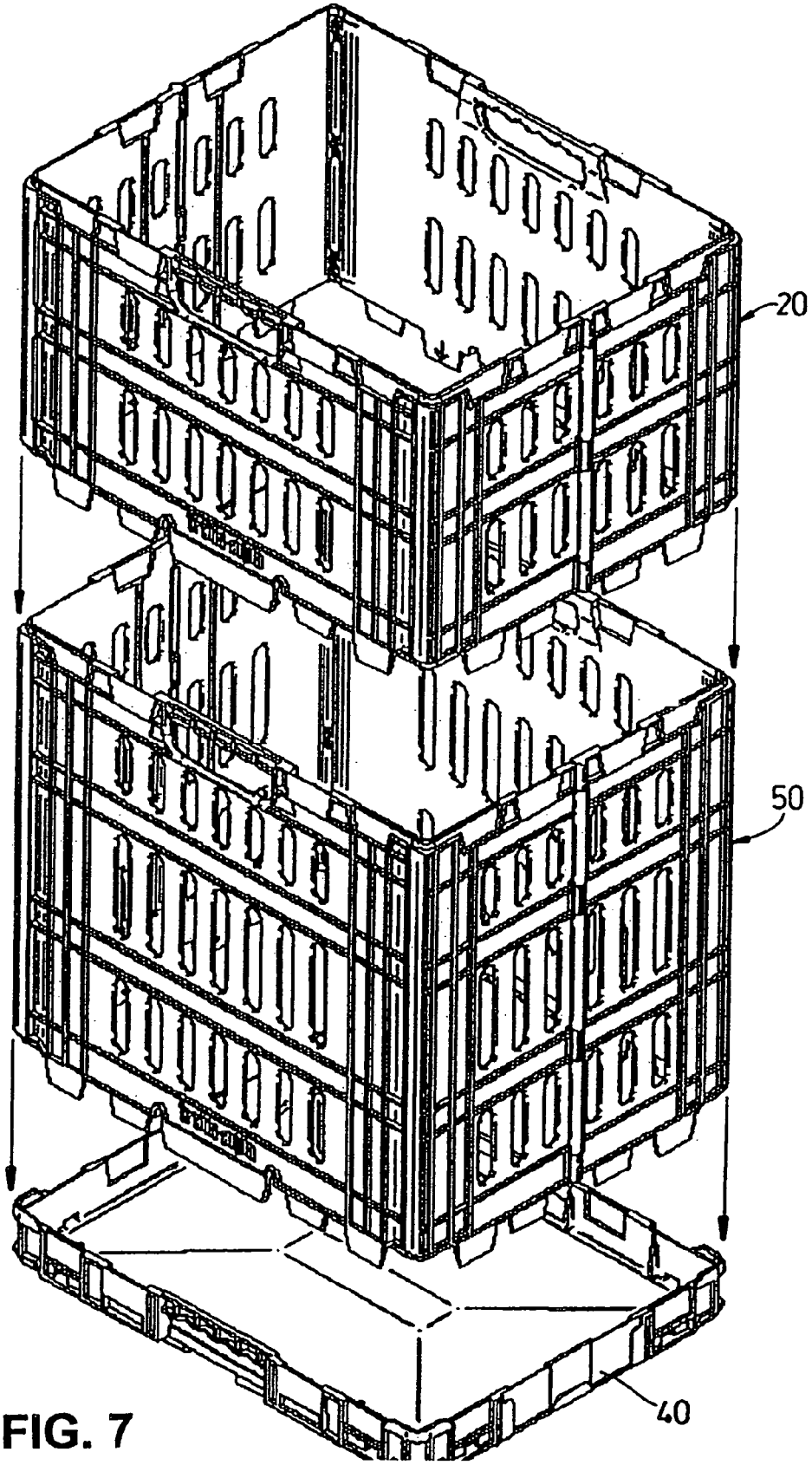
FIG. 7 shows a perspective view of two enclosure assemblies of the type shown in FIG. 1 and the tray shown in FIG. 6.
Figure 8:
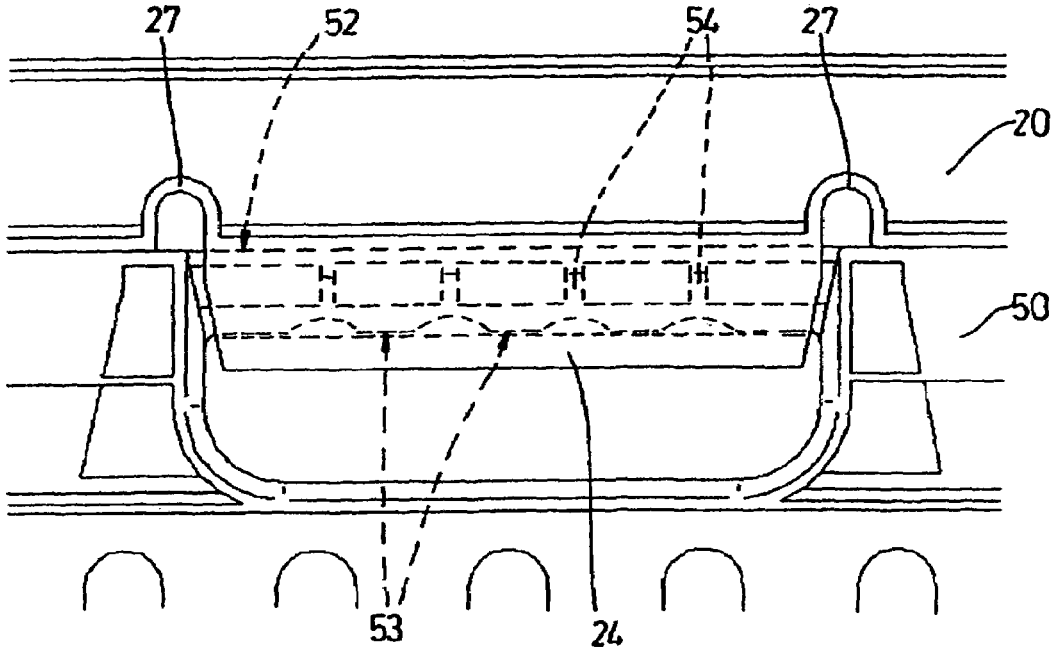
FIG. 8 is a detailed view of the enclosure assemblies of FIG. 7 in an attached condition.

FIGS. 7 and 8 illustrate the use of the enclosure assembly 20, together with the tray 40 and an enclosure assembly 50. The enclosure assembly 50 is substantially identical to enclosure assembly 20, save for the fact that assembly 50 is approximately twice as high as the assembly 20.

In use the assembly 50 is initially pushed downwards into the tray 40 and in doing so the protrusions of the tongues on the lower margin contact with the outwardly facing ribs 44 of each respective handle of the tray 40. Such contact urges the tongues to deflect generally outwardly of the assembly 50. With continual downward movement the tongues of the assembly 50 negotiate the handles and, by virtue of the inherent resilience of the tongues, the tongues 'snap' into a attached condition. Furthermore, in such an attached condition the tabs of assembly 50 are located in respective recesses 42 of the tray 40. The assembly 50 is thus attached to the tray 40, and encloses a region thereabove.

Similarly, the assembly 20 is then pushed downwards onto the upper margin of the assembly 50, so that the protrusions 28 of the assembly 20

Similarly, the assembly 20 is then pushed downwards onto the upper margin of the assembly 50, so that the protrusions 28 of the assembly 20 contact with the ribs 54 and then snap into position under the respective handles 52 of assembly 50, and the tabs 26 being located by the respective recesses on the upper margin of the assembly 50.

As can be seen in FIG. 8, in the attached condition of the assembly 50 the protrusion 28 of the tongue 24 is located under the handle 52 and said protrusion bears against flat surface portions 53 of the handle 52.

The stacked arrangement of FIG. 7 is particularly advantageous when the container holds tall goods, such as plants, the height of which is greater than that of an enclosure assembly, in which case a second enclosure assembly is attached onto a first enclosure assembly. Thus advantageously the same mechanism is used to attach an enclosure assembly to a container as to attach an enclosure assembly to another enclosure assembly.

Advantageously the stacked enclosure assemblies form a substantially rigid structure the height of which can be chosen in accordance which the height of the goods to be transported.

Advantageously, enclosure assemblies of different heights can be manufactured, but, importantly, comprising co-operable attachment means, which offer to a user an increased number of possible stack height configurations.

Although specific reference has been made to a stack comprising only two enclosure assemblies it will be appreciated that a stack of three or more enclosure assemblies is possible depending on the height of the goods to be transported.

Since both of the above described embodiments are collapsible to a substantially flat condition the assemblies can be readily stowed.

It will be appreciated that in all of the embodiments hereinbefore described the co-operation between the attachment means of an upper enclosure assembly and the attachment means of a lower adjacent enclosure assembly or a lower adjacent container or tray is sufficient to suspend that lower assembly or container or tray when the upper enclosure assembly is lifted. The co-operation is desirably sufficient so that a stack of multiple enclosure assemblies and a container or tray (with the goods therein) can be lifted from one of the enclosure assemblies of the stack.

The invention claimed is:

1. Packaging, comprising:

at least two enclosure assemblies which are adapted to be supported on a container and in situ the enclosure assemblies enclose a region above the container, each enclosure assembly comprising co-operable attachment means and handle means, an arrangement of a first enclosure assembly being such that the attachment means of the first enclosure assembly which is adapted to be supported on a container is engaged with the attachment means of a second enclosure assembly, aid enclosure assemblies forming a stack in which the second enclosure assembly encloses a region above the first enclosure assembly, each enclosure assembly being characterized in that a first part of the attachment means comprises protrusion means and a second art of the attachment means comprises protrusion receiving means, the protrusion receiving means being provided by a space which is sized to allow the fingers of a person to pass therethrough, and the space being provided below the handle means, the enclosure assemblies having a substantially tubular form defined by two side walls and two end walls that determine a first margin and a second margin of the assemblies at respective first and second distal ends thereof, the assemblies having openings at the distal ends, the openings being at least as large as the first margin and second margin, respectively, wherein the protrusion means is arranged to be moved generally laterally outwardly of one assembly so as to disengage the a attachment means of two such assemblies, each enclosure assembly further comprising a locating tab extending from each of the walls at the first margin, and a tab receiving recess provided in each of the walls at the second margin, and the locating tab and the tab receiving recesses arranged such that one of the tabs and the recesses of the first enclosure assembly locate with one of the recesses and tabs, respectively, of the second enclosure assembly.

2. Packaging as claimed in claim 1, wherein in each enclosure assembly the first art of the attachment means is spaced from the second part of the attachment means in the direction of the height of the enclosure assembly.

3. Packaging as claimed in claim 2, wherein in each enclosure assembly the first part of the attachment means and the second part of the attachment means are located towards respective distal ends of the enclosure assembly.

4. Packaging as claimed in claim 3, wherein in each enclosure assembly the first art of the attachment means is located towards a lowermost margin of the enclosure assembly and the second part of the attachment means is located towards an uppermost margin of the enclosure assembly.

5. Packaging as claimed in claim 1, wherein the first part of the attachment means of one enclosure assembly is adapted to be engaged with the second part of the attachment means of another assembly.

6. Packaging as claimed in claim 1 in which engagement between the first part of the attachment means and the second part of the attachment means is by way of a male-to-female engagement.

7. Packaging as claimed in claim 1 in which the first part of the attachment means of the first enclosure assembly is adapted to engage with the container so that the first enclosure assembly is secured to the container to enclose a region above said container.

8. Packaging as claimed in claim 1 in which the protrusion means is of a tapered profile.

9. Packaging as claimed in claim 8 in which the tapered profile widens laterally of the enclosure assembly with increasing height of the enclosure assembly.

10. Packaging as claimed in claim 1 in which the protrusion means is provided secured to a resilient portion.

11. Packaging as claimed in claim 10 in which the resilient portion extends generally downwards of the enclosure assembly.

12. Packaging as claimed in claim 1, wherein each enclosure assembly is of oblong rectangular shape, protrusion means being provided on opposite sides of each enclosure assembly.

13. Packaging as claimed in claim 1 wherein the first enclosure assembly comprises enclosure assembly attachment means and container attachment means, the enclosure assembly attachment means being physically distinct from the container attachment means.

14. Packaging as claimed in claim 1 in which the attachment means of each enclosure assembly is such that the stack and the container may be lifted from the handle means.

* * * * *